US006520617B2

(12) United States Patent
Blair

(10) Patent No.: US 6,520,617 B2
(45) Date of Patent: Feb. 18, 2003

(54) DROP EMITTING APPARATUS

(75) Inventor: Dustin W Blair, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/898,713

(22) Filed: Jul. 2, 2001

(65) Prior Publication Data

US 2003/0001919 A1 Jan. 2, 2003

(51) Int. Cl.[7] ..... B41J 2/015

(52) U.S. Cl. ..... 347/20; 347/47; 347/45; 347/56; 347/57; 347/58; 347/59

(58) Field of Search ..... 347/20, 47, 45, 347/56, 57, 58, 59

(56) References Cited

U.S. PATENT DOCUMENTS 4,380,771 A * 4/1983 Takatori ..... 347/43
6,074,036 A * 6/2000 Nishioka et al. ..... 347/20
6,179,412 B1 * 1/2001 Ishinaga et al. ..... 347/63

* cited by examiner

*Primary Examiner*—John Barlow
*Assistant Examiner*—Ly Tran

(57) ABSTRACT

A drop emitting device that includes a plurality of nozzle openings and a plurality of grooves in the vicinity of the nozzle openings.

9 Claims, 2 Drawing Sheets

DROP EMITTING APPARATUS

BACKGROUND OF THE INVENTION

The art of ink jet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the *Hewlett-Packard Journal*, Vol. 36, No. 5 (May 1985); Vol. 39, No. 5 (October 1988); Vol. 43, No. 4 (August 1992); Vol. 43, No. 6 (December 1992); and Vol. 45, No. 1 (February 1994); all incorporated herein by reference.

Generally, an ink jet image is formed pursuant to precise placement on a print medium of ink drops emitted by an ink drop generating device known as an ink jet printhead. Typically, an ink jet printhead is supported on a movable print carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

A typical Hewlett-Packard ink jet printhead includes an array of precisely formed nozzles in an orifice plate that is attached to an ink barrier layer which in turn is attached to a thin film substructure that implements ink firing heater resistors and apparatus for enabling the resistors. The ink barrier layer defines ink channels including ink chambers disposed over associated ink firing resistors, and the nozzles in the orifice plate are aligned with associated ink chambers. Ink drop generator regions are formed by the ink chambers and portions of the thin film substructure and the orifice plate that are adjacent the ink chambers.

The thin film substructure is typically comprised of a substrate such as silicon on which are formed various thin film layers that form thin film ink firing resistors, apparatus for enabling the resistors, and also interconnections to bonding pads that are provided for external electrical connections to the printhead. The ink barrier layer is typically a polymer material that is laminated as a dry film to the thin film substructure, and is designed to be photodefinable and both UV and thermally curable. Ink is fed from one or more ink reservoirs to the various ink chambers around ink feed edges that can comprises sides of the thin film substructure or sides of ink feed slots formed in the substrate.

An example of the physical arrangement of the orifice plate, ink barrier layer, and thin film substructure is illustrated at page 44 of the *Hewlett-Packard Journal* of February 1994, cited above. Further examples of ink jet printheads are set forth in commonly assigned U.S. Pat. No. 4,719,477 and U.S. Pat. No. 5,317,346, both of which are incorporated herein by reference.

Considerations with ink jet printheads include puddling on the nozzle plate which can affect print quality and reliability.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
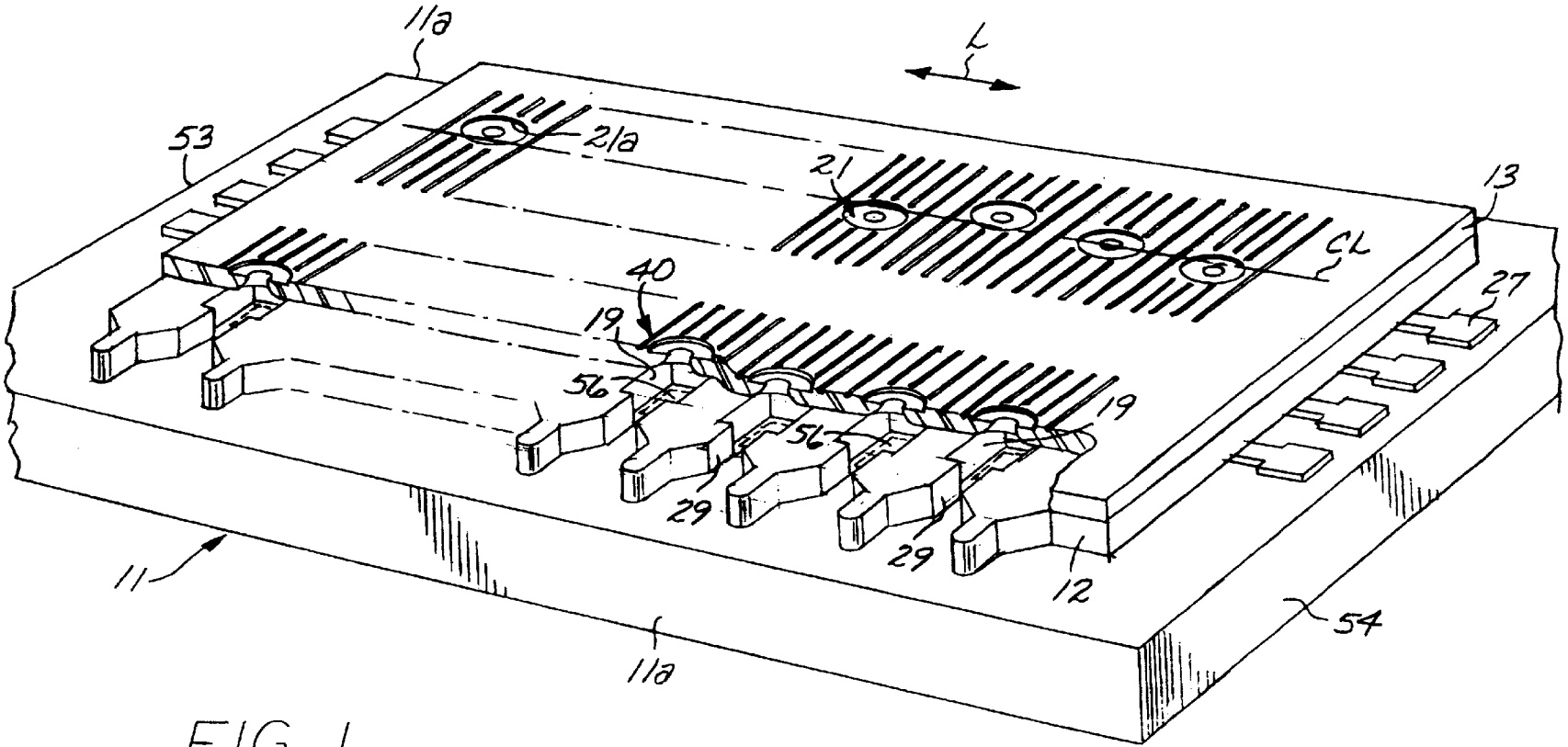
FIG. 1 is a schematic, partially sectioned perspective view of an ink jet printhead that employs the invention.

In the following detailed description and in the several figures of the drawing, like elements are identified with like reference numerals.

Referring now to FIG. 1, set forth therein is an unscaled schematic perspective view of an ink jet printhead in which the invention can be employed and which generally includes (a) a thin film substructure or die 11 comprising a substrate such as silicon and having various thin film layers formed thereon, (b) an ink barrier layer 12 disposed on the thin film substructure 11, and (c) an orifice or nozzle plate 13 attached to the top of the ink barrier 12.

The thin film substructure 11 is formed pursuant to integrated circuit fabrication techniques, and includes thin film heater resistors 56 formed therein. By way of illustrative example, the thin film heater resistors 56 are located in rows along longitudinal ink feed edges 11*a* of the thin film substructure 11.

The ink barrier layer 12 is formed of a dry film that is heat and pressure laminated to the thin film substructure 11 and photodefined to form therein ink chambers 19 and ink channels 29. Gold bond pads 27 engagable for external electrical connections are disposed at the ends of the thin film substructure 11 and are not covered by the ink barrier layer 12. By way of illustrative example, the barrier layer material comprises an acrylate based photopolymer dry film such as the Parad brand photopolymer dry film obtainable from E.I. duPont de Nemours and Company of Wilmington, Del. Similar dry films include other duPont products such as the "Riston" brand dry film and dry films made by other chemical providers. The orifice plate 13 comprises, for example, a planar substrate comprised of a polymer material and in which the orifices are formed by laser ablation, for example as disclosed in commonly assigned U.S. Pat. No. 5,469,199, incorporated herein by reference. The orifice plate can also comprise, by way of further example, a plated metal such as nickel.

The ink chambers 19 in the ink barrier layer 12 are more particularly disposed over respective ink firing resistors 56 formed in the thin film substructure 11, and each ink chamber 19 is defined by the edge or wall of a chamber opening formed in the barrier layer 12. The ink channels 29 are defined by further openings formed in the barrier layer 12, and are integrally joined to respective ink firing chambers 19.

The orifice plate 13 includes orifices 21 disposed over respective ink chambers 19, such that an ink firing resistor 56, an associated ink chamber 19, and an associated orifice 21 form an ink drop generator 40. Optionally, an orifice 21 can include an outlet counterbore 21*a*.

While the disclosed printheads are described as having a barrier layer and a separate orifice plate, it should be appreciated that the printheads can be implemented with an integral barrier/orifice structure that can be made, for example, using a single photopolymer layer that is exposed with a multiple exposure process and then developed.

The ink drop generators 40 are arranged in columnar arrays or groups that extend along a reference axis L. By way of illustrative example, the columnar arrays of ink drop generators 40 are spaced apart from each other laterally or transversely relative to the reference axis L and are adjacent respective ink feed edges 11*a*.

The thin film substructure 11 can be rectangular, wherein ink feed edges 11*a* are longitudinal edges of a length dimension while longitudinally spaced apart, opposite edges 53, 54 are of a width or lateral dimension that is less than the length of the thin film substructure 11. The longitudinal extent of the thin film substructure 11 is along the ink feed edges 11*a* which can be parallel to the reference axis L.

The ink drop generators in a column can be staggered so that at least some of the nozzles 21 are slightly off a center line CL of the column that is parallel to the reference axis L. In this manner, the nozzles 21 of a particular column of drop generators can be at different distances from the associated ink feed edge 11*a* of the thin film substructure. Staggering of nozzles can be employed to compensate for firing delays, for example, in printing applications wherein printing is accomplished by relative movement between the printhead and a print medium along a carriage scan axis CA that is perpendicular to the reference axis L. In such application, the reference axis L can be aligned with what is generally referred to as the paper or media axis MA.

Figure 2:
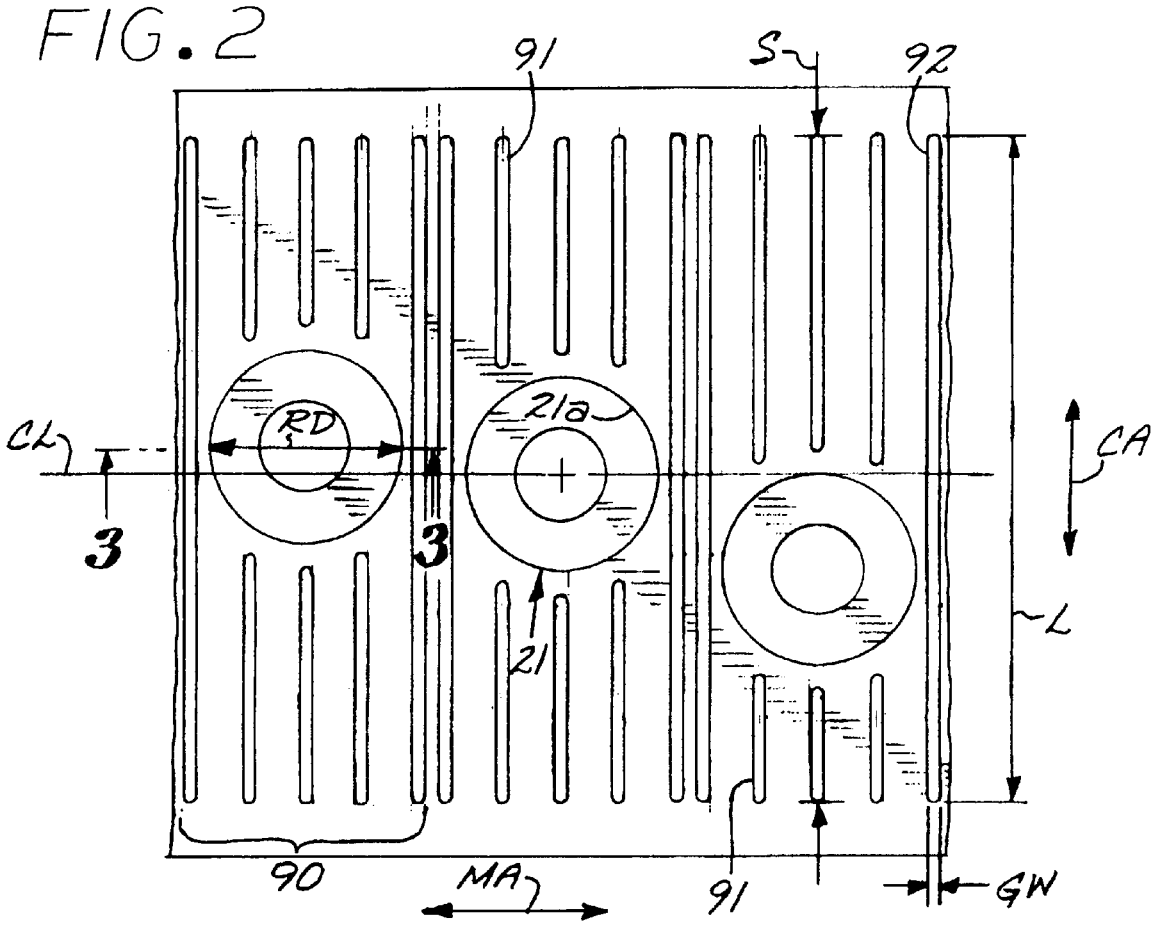
FIG. 2 is an unscaled schematic top plan view illustrating the configuration of a plurality of representative ink chambers, ink channels, and barrier islands of the printhead of FIG. 1.
Figure 3:
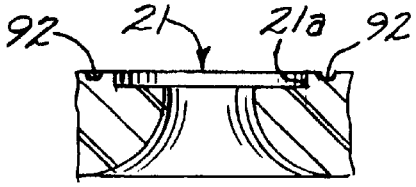
FIG. 3 is an unscaled schematic sectional view of a nozzle of the printhead of FIG. 1.

Referring now to FIG. 2, small narrow trenches or grooves 91, 92 are formed in the top surface of the orifice plate 13 in the vicinity of the nozzles. The grooves 91, 92 do not connect with the orifices 21. The grooves 91 more particularly are disposed on one side of the orifices 21, while the grooves 92 pass between adjacent nozzles. The grooves encourage puddled ink in the vicinity of the nozzles to flow away from the nozzles, for example by wicking the puddled ink away from the vicinity of the nozzles. Two grooves 91 between adjacent nozzles also tend to prevent the formation of layer puddles between nozzles by preventing merger of puddles from adjacent nozzles.

For example, associated with each nozzle is a group 90 of grooves that includes two parallel longer grooves 91 located adjacent diametrically opposite points of a reference diameter RD of the nozzle opening and spaced from such nozzle opening by at least 3 micrometers. The reference diameter RD can be parallel to the column axis CL. The group 90 of grooves further includes a plurality of shorter grooves 92 that are parallel to and located between the longer grooves 91 associated with a nozzle. The shorter grooves 92 extend laterally or transversely relative to the reference diameter RD, and can be arranged in colinear pairs each having a short groove on one side of the nozzle and a short groove on the other side of the nozzle. Such sides of a nozzle are the semi-circular edges or boundaries of the nozzle on either side of the reference diameter RD. The grooves 91, 92 associated with a nozzle opening can be uniformly spaced along a direction parallel to the reference diameter.

Adjacent grooves 91 respectively associated with adjacent nozzles can be more closely spaced than the grooves 91, 92 of a group 90 of grooves.

Each of the grooves 91, 92 can have rounded ends and a groove width GW in the range of about 2 micrometers to 5 micrometers. By way of illustrative example, the length L of the longer grooves 91 can be about 400 micrometers, and the distance S between the distal ends of a colinear pair of grooves 92 is about 400 micrometers. The transverse most ends of the grooves 91, 92 on each side of the column of nozzles can be colinear and parallel to the longitudinal axis CL of the column of nozzles or the reference diameter RD. Also, the transverse most ends of the grooves 91, 92 can be non-colinear.

Generally, the grooves 91, 92 can be oriented so as to be substantially parallel to the carriage scan axis CA of a printer in which the printhead is installed.

Although the foregoing has been a description and illustration of specific embodiments of the invention, various modifications and changes thereto can be made by persons skilled in the art without departing from the scope and spirit of the invention as defined by the following claims.

What is claimed is:

1. An ink jet printhead comprising:

a printhead structure including a nozzle plate;

a plurality of nozzles formed in said nozzle plate; and a plurality of grooves formed in said nozzle plate in a vicinity of said nozzles, wherein said plurality of grooves includes colinear pairs of grooves, each pair comprised of grooves on opposite sides of a nozzle.

2. An ink jet printhead comprising:

a printhead structure including a nozzle plate;

a plurality of nozzles formed in said nozzle plate and arranged in a columnar array; and a plurality of grooves formed in said nozzle plate in a vicinity of said nozzles, wherein said plurality of grooves includes colinear pairs of grooves, each pair comprised of grooves on opposite sides of a nozzle.

3. An ink jet printhead comprising:

a printhead structure including a nozzle plate;

a column of nozzles formed in said nozzle plate; and a plurality of parallel grooves formed in said nozzle plate in the vicinity of said nozzles, said parallel grooves being parallel to a carriage scan axis, and wherein said plurality of grooves includes colinear pairs of grooves, each pair comprised of grooves on opposite sides of a nozzle.

4. An ink jet printhead comprising:

a printhead structure including a nozzle plate;

a plurality of nozzles formed in said nozzle plate; and a plurality of grooves formed in said nozzle plate in a vicinity of said nozzles for encouraging ink puddles to flow away from said nozzles, and wherein said plurality of grooves includes colinear pairs of grooves, each pair comprised of grooves on opposite sides of a nozzle.

5. A fluid drop emitting apparatus comprising:

a drop emitting structure including a plurality of nozzle openings arranged in a generally columnar array along a longitudinal axis, each nozzle opening having a first side on one side of a reference diameter that is parallel to the longitudinal axis and a second side on another side of the reference diameter; and a first plurality of grooves adjacent said first side of each nozzle opening; and a second plurality of grooves adjacent said second side of each nozzle opening.

6. The fluid drop emitting apparatus of claim 5 wherein said first plurality of grooves comprise parallel grooves.

7. The fluid drop emitting apparatus of claim 5 wherein said second plurality of grooves comprise parallel grooves.

8. The fluid drop emitting apparatus of claim 5 further including a groove that extends between adjacent nozzles.

9. The fluid drop emitting apparatus of claim 5 further including two grooves that extend between adjacent nozzles.

* * * * *